US007971539B2

(12) United States Patent
Eriksson et al.

(10) Patent No.: US 7,971,539 B2
(45) Date of Patent: Jul. 5, 2011

(54) CLEANING DEVICE, CLEANING TOOL AND METHOD OF USING THE CLEANING DEVICE

(75) Inventors: Ulf Eriksson, Enskede (SE); Pär Åke Jansson, Umeå (SE)

(73) Assignee: Eie Maskin AB, Bandhagen (SE)

( * ) Notice: Subject to any disclaimer, the term of this patent is extended or adjusted under 35 U.S.C. 154(b) by 862 days.

(21) Appl. No.: 10/962,534

(22) Filed: Oct. 13, 2004

(65) Prior Publication Data

US 2005/0109370 A1 May 26, 2005

Related U.S. Application Data

(60) Provisional application No. 60/511,700, filed on Oct. 17, 2003.

(51) Int. Cl.
*F23G 7/04* (2006.01)

(52) U.S. Cl. ..... 110/238; 122/379

(58) Field of Classification Search ..... 15/246, 15/104.03, 104.05, 104.16, 316.1; 162/272; 266/135, 269; 122/379; 110/238
See application file for complete search history.

(56) References Cited

U.S. PATENT DOCUMENTS

| | | | | |
|---|---|---|---|---|
| 1,262,755 A * | 4/1918 | Cutler | ..... | 15/104.16 |
| 4,706,324 A | 11/1987 | Goodspeed | | |
| 5,000,260 A * | 3/1991 | Fontenot | ..... | 166/173 |
| 5,542,650 A * | 8/1996 | Abel et al. | ..... | 266/135 |
| 6,431,125 B1 | 8/2002 | Eriksson | | |

* cited by examiner

*Primary Examiner* — Kenneth B Rinehart
(74) *Attorney, Agent, or Firm* — Dykema Gossett PLLC

(57) ABSTRACT

A cleaning device, cleaning tool and method for cleaning outlet ports or the like and/or outlet spouts (12) or the like in soda recovery boilers of the like the cleaning device including at least one connecting rod and at least one front tool part mounted on the connecting rod.

13 Claims, 6 Drawing Sheets

CLEANING DEVICE, CLEANING TOOL AND METHOD OF USING THE CLEANING DEVICE

CROSS-REFERENCE TO RELATED APPLICATION

This application claims the benefit of Provisional Application No. 60/511,700, filed Oct. 17, 2003.

The present invention relates to a cleaning device for cleaning outlet ports or the like and/or outlet spouts or the like in soda recovery boilers or the like. The invention also relates to a cleaning tool for use in the cleaning device as well as two methods of using the cleaning device.

PRIOR ART

Liquid soda that is tapped from a soda recovery boiler usually passes at least one outlet port and an outlet spout located under the same. The soda running out of the boiler has a temperature of approx. 1000° C. and, upon contact with air, a part of the soda solidifies and forms a solid "covering" in the port and the spout. Solidified soda blocks the flow and it occurs that lumps are to pass in the spout as well as that liquid soda splashes out in the boiler room. The usual way today to prevent that solidified soda blocks the flow is to clean outlet ports and outlet spouts manually at regular intervals by means of long levers. This work is heavy and risky.

SUMMARY OF THE INVENTION

A first object of the present invention is to provide a cleaning device that is efficient in cleaning. A second object of the present invention is to provide a cleaning device that is useful for automatic cleaning. A third object of the present invention is to provide a cleaning tool for use in the cleaning device. A fourth object of the present invention is to provide methods to use the cleaning device that give the intended cleaning effect and simultaneously require minimal manual effort.

Thus, the invention comprises a cleaning device for cleaning outlet ports or the like and/or outlet spouts or the like in soda recovery boilers or the like, the cleaning device comprising at least one connecting rod. At least one front tool part is found, mounted on said connecting rod.

The cleaning device may comprise at least one rear tool part, mounted on said front tool part.

Said front tool part may in turn comprise at least one first cleaning part and at least one first holder part with bracket, said first cleaning part having a shape and size that closely connects to the corresponding shape and size of an outlet port or the like that is to be cleaned, so that said first cleaning part, if required, can be inserted into the outlet port and clean the same from solidified soda, cinder or the like.

Said first cleaning part may be in the shape of a hollow cylinder open in the ends, which cylinder has an essentially circular or oval cross-section. At least one slot may be present in the envelope surface of said cylinder. Said slot may run in the longitudinal direction of the cylinder, from one end to the other of the cylinder and through the entire length thereof, whereby said first cleaning part gets radially resilient properties.

Said rear tool part may in turn comprise at least one second cleaning part and at least one second holder part with bracket, said second cleaning part having is a shape and size that closely connects to the corresponding shape and size of the interior of an outlet spout or the like that is to be cleaned, so that said second cleaning part, if required, can be inserted into the outlet spout and clean the same from solidified soda, cinder or the like. Said second cleaning part may comprise at least one flange-like scraping device, which upon cleaning scrapes in the outlet spout.

Said second holder part may be articulately connected to said first holder part. Said first holder part may be connected to the front part of said connecting rod. Said connecting rod may be connected to a drive mechanism enabling automatic operation of the cleaning device in a way decided beforehand.

Thus, the invention also comprises a cleaning tool for use in the cleaning device according to the above. The cleaning tool comprises at least one front tool part for mounting on a connecting rod.

The cleaning tool may comprise at least one rear tool part, mounted on said front tool part.

Said front tool part may in turn comprise at least one first cleaning part and at least one first holder part with bracket, said first cleaning part having a shape and size that closely connects to the corresponding shape and size of an outlet port or the like that is to be cleaned, so that said first cleaning part, if required, can be inserted into the outlet port and clean the same from solidified soda, cinder or the like. Said rear tool part may in turn comprise at least one second cleaning part and at least one second holder part with bracket, said second cleaning part having a shape and size that closely connects to the corresponding shape and size of the interior of an outlet spout or the like that is to be cleaned, so that said second cleaning part, if required, can be inserted into the outlet spout and clean the same from solidified soda, cinder or the like.

Thus, the invention also comprises a method of using the cleaning device according to the above for cleaning outlet ports or the like in soda recovery boilers or the like. The method comprises the steps of (A) directing the cleaning device against an outlet port or the like that is to be cleaned and in that connection locating a front end of a first cleaning part essentially right opposite said outlet port, (B) inserting said first cleaning part into said outlet port sufficiently far in order to clean the port from occurring solidified soda, cinder or the like, and (C) bringing back said first cleaning part entirely from said outlet port.

Thus, the invention also comprises a method of using the cleaning device according to the above for cleaning outlet spouts or the like in soda recovery boilers or the like. The method comprises the step of (D) bringing the cleaning device along an outlet spout or the like that is to be cleaned and in such a way that a first cleaning part and/or a second cleaning part will run in the outlet spout essentially through the entire length thereof and hence clean the spout from occurring solidified soda, cinder or the like.

The cleaning device can be brought along said outlet spout in such a way that said second cleaning part also will run past the lower end of the outlet spout, said second cleaning part also cleaning around said lower end and under the spout in an area closest to said lower end, possible beard-like formations in the form of solidified soda, cinder or the like being removed. The cleaning device can be operated automatically by means of a drive mechanism.

LIST OF DRAWINGS

Figure 1:
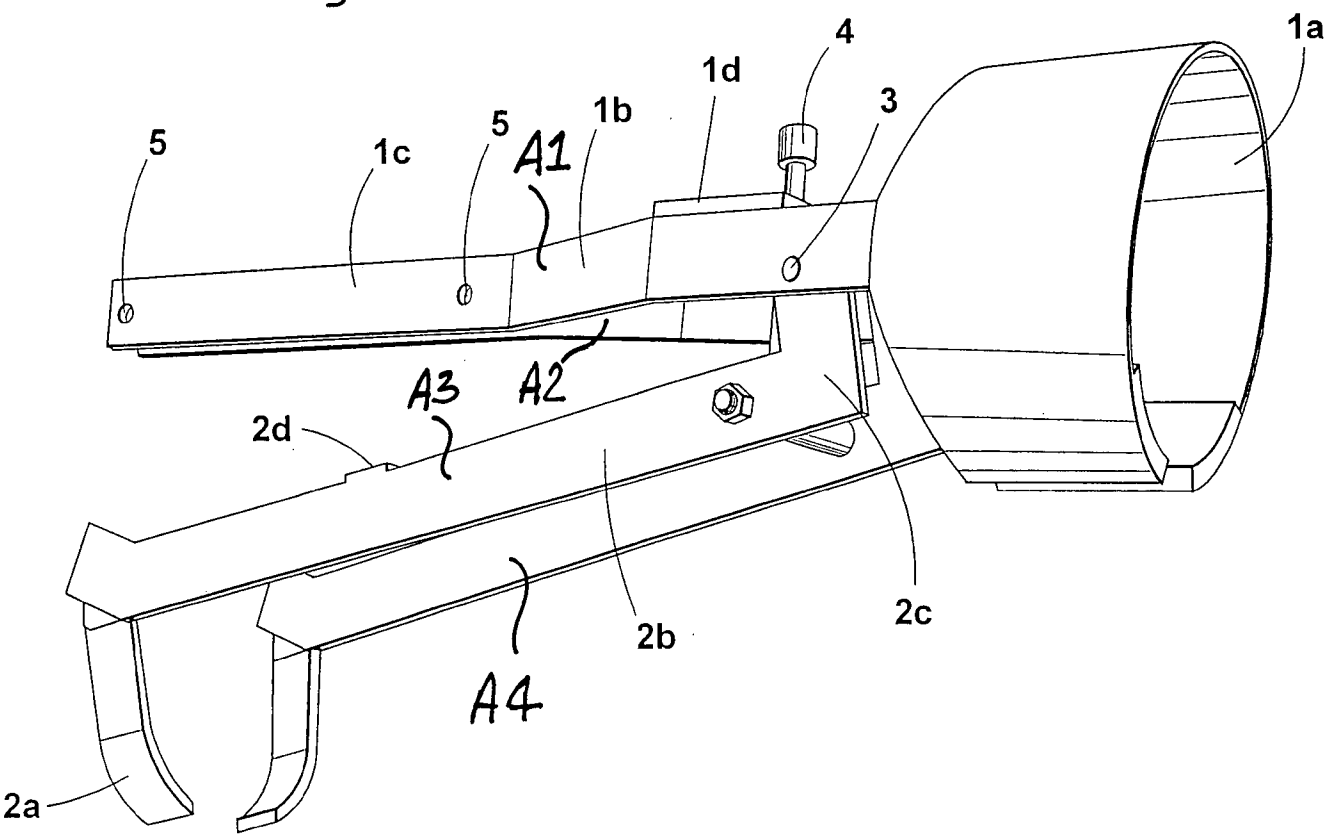
FIG. 1 shows, in a perspective view, a cleaning tool according to the invention included in a cleaning device according to the invention.
Figure 3A:
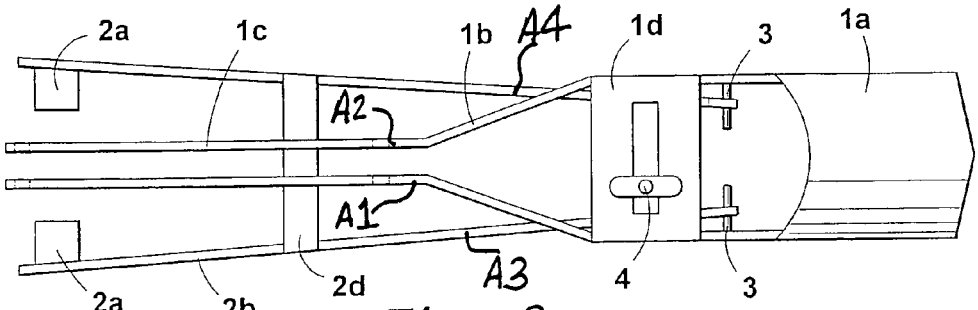

FIG. 3*a* shows, in a view from above, the tool according to FIG. 1.

Figure 3B:
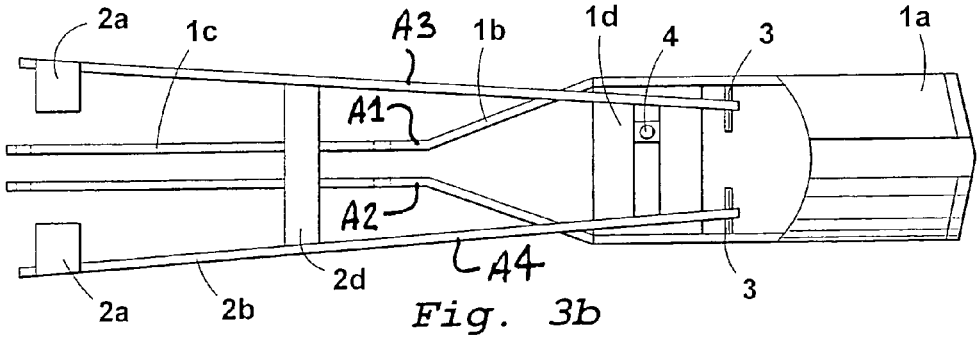

FIG. 3*b* shows, in a view from below, the tool according to FIG. 1.

Figure 2:
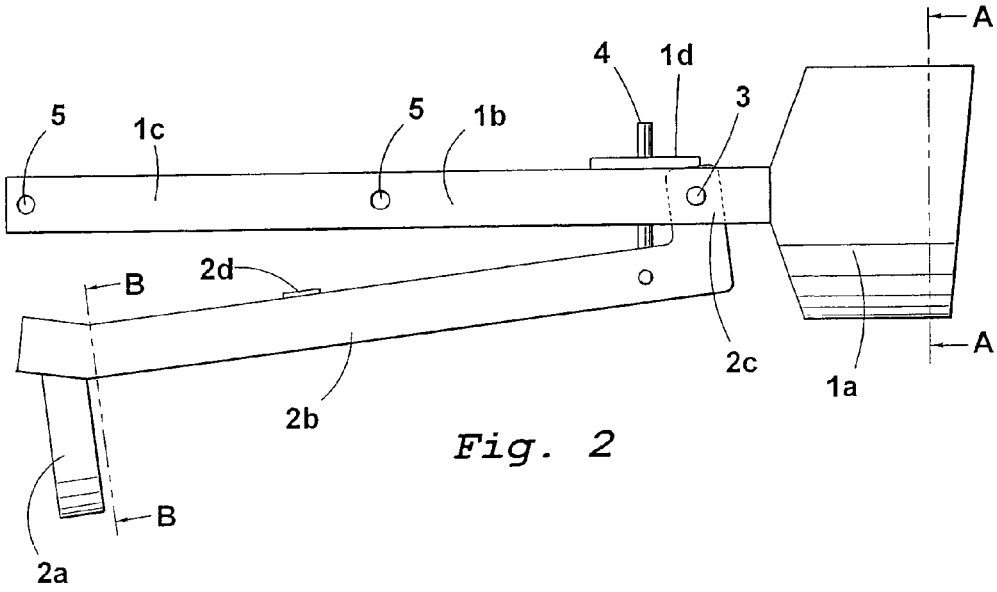
FIG. 2 shows, in a side view, the tool according to FIG. 1.
Figure 4:
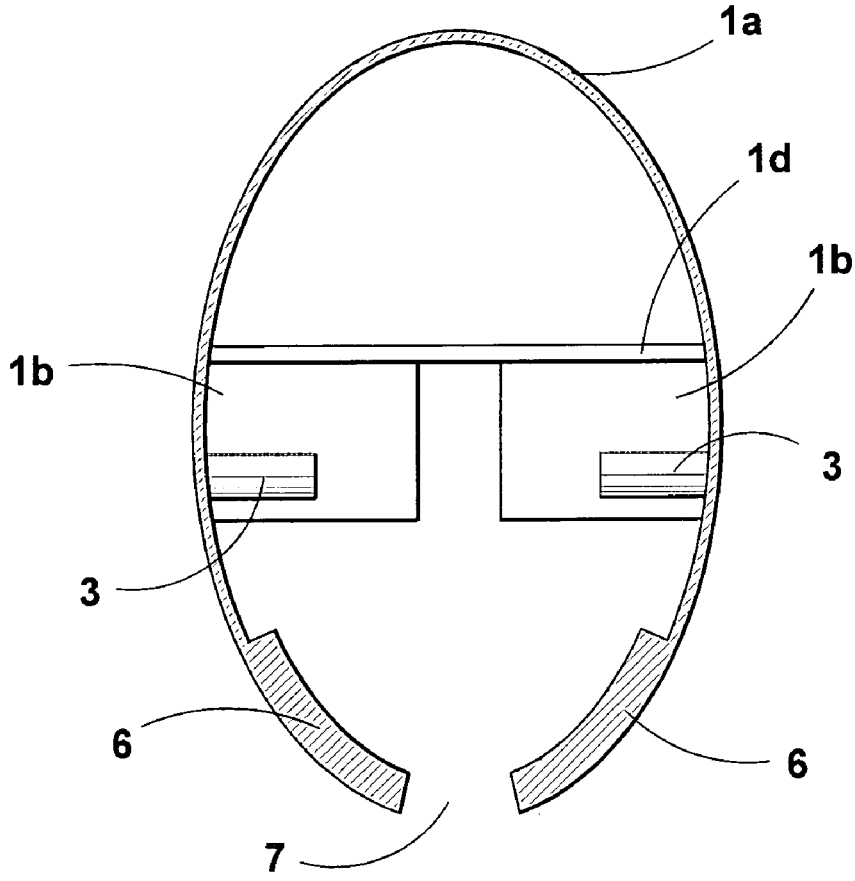

FIG. 4 shows, in a section along the line A-A in FIG. 2, a front part of the tool according to FIG. 1.

Figure 5:
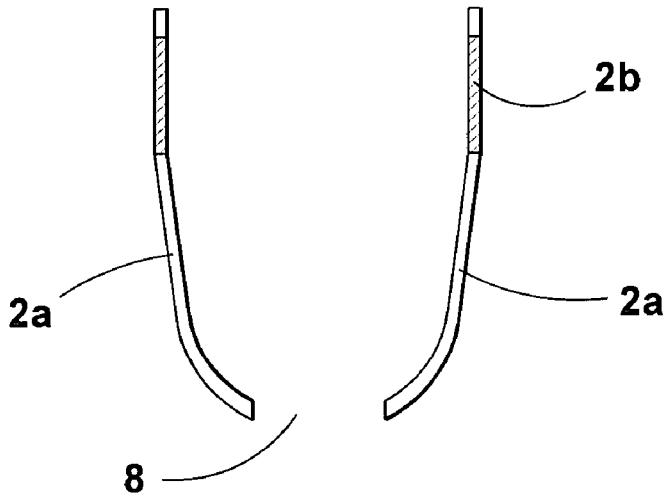

FIG. 5 shows, in a section along the line B-B in FIG. 2, a rear part of the tool according to FIG. 1.

Figure 6:
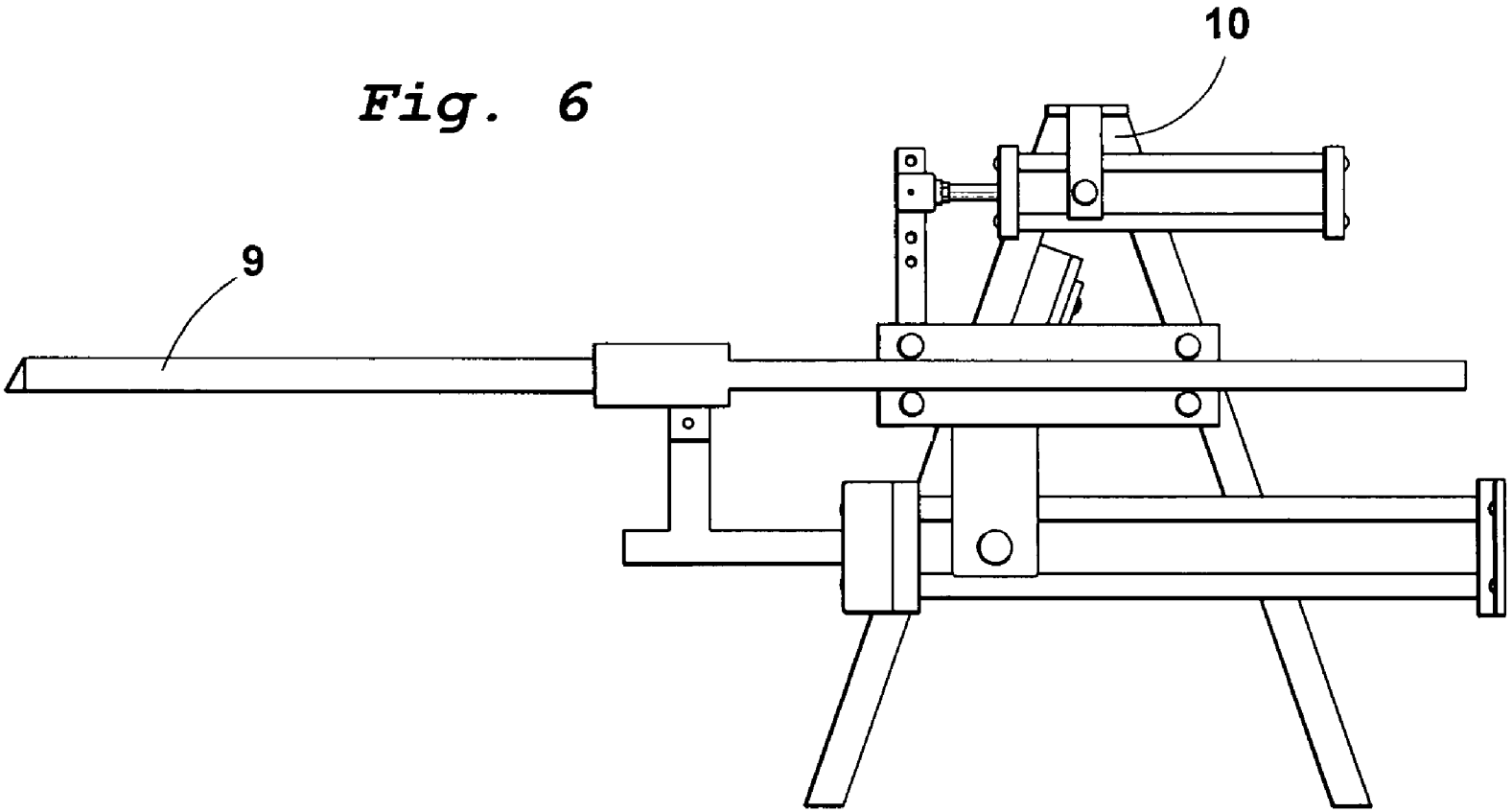

FIG. 6 shows, in a side view from a first side, a connecting rod and a drive mechanism intended for use with the tool in FIG. 1 and included in a cleaning device according to the invention.

Figure 7:
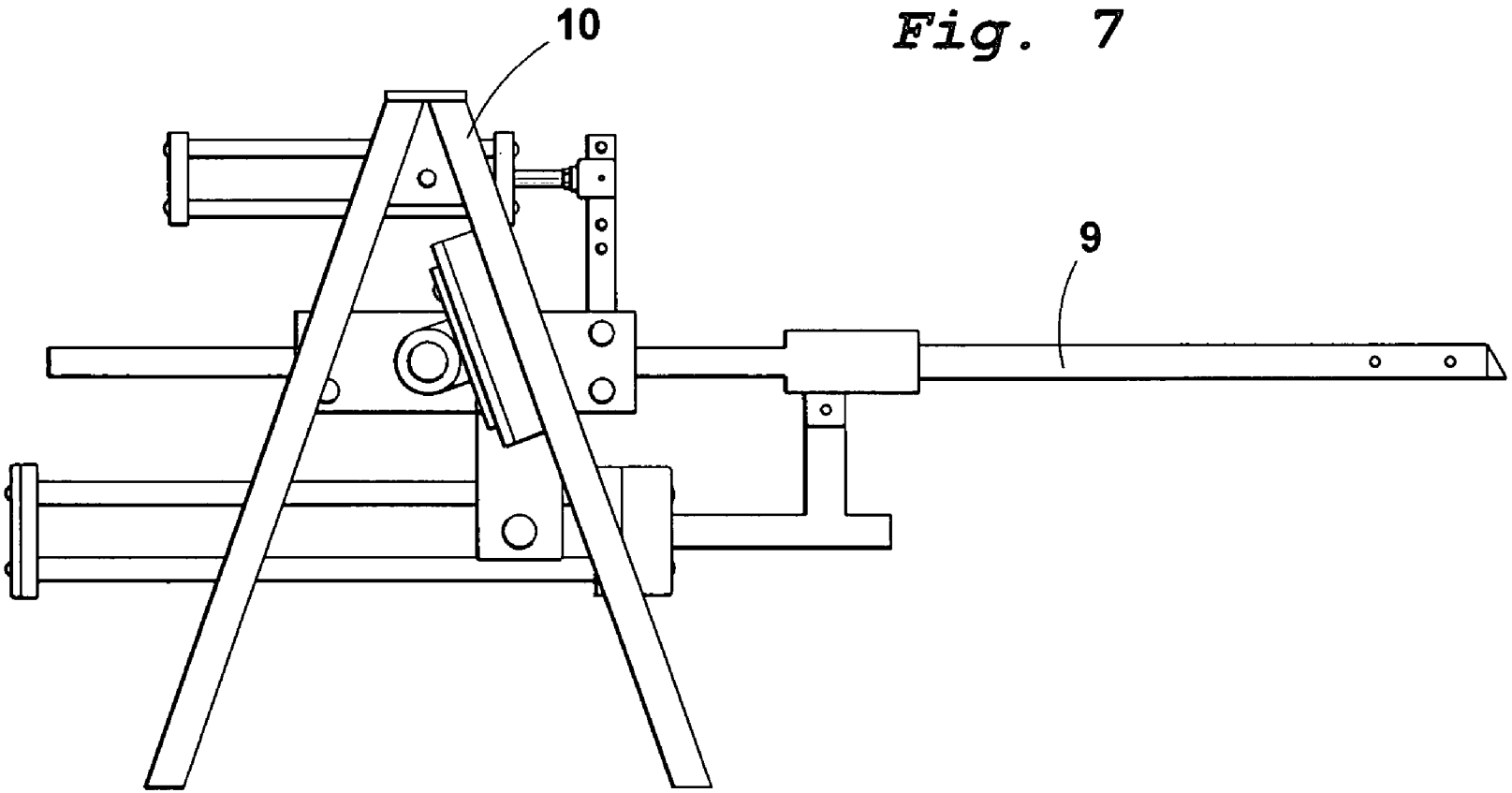

FIG. 7 shows, in a side view from a second side, the connecting rod and the drive mechanism according to FIG. 6.

Figure 8A:
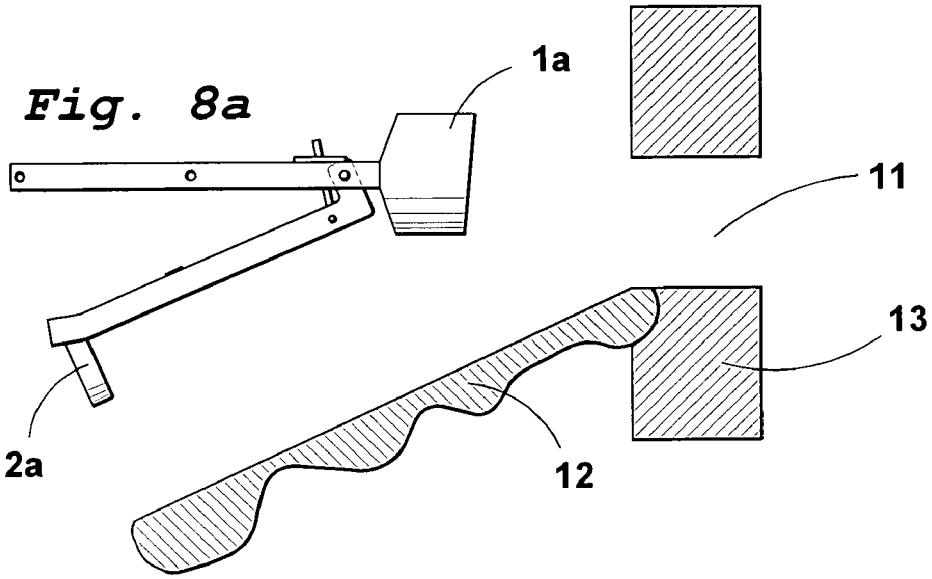

FIG. 8*a* shows, in a side view, a starting position in cleaning by means of the tool according to FIG. 1.

Figure 8B:
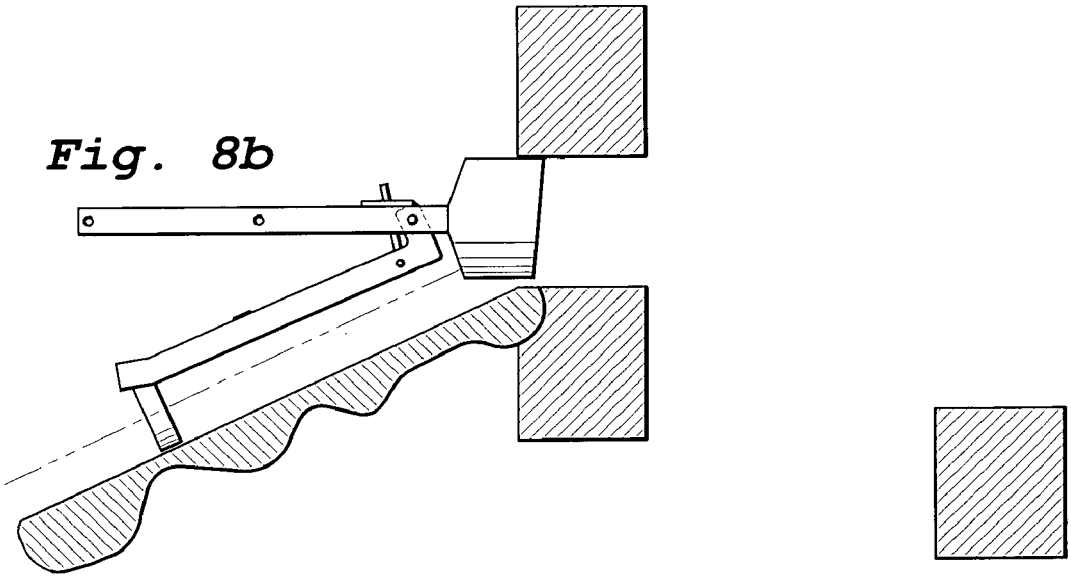

FIG. 8*b* shows, in a side view, a first operation position in cleaning by means of the tool according to FIG. 1.

Figure 8C:
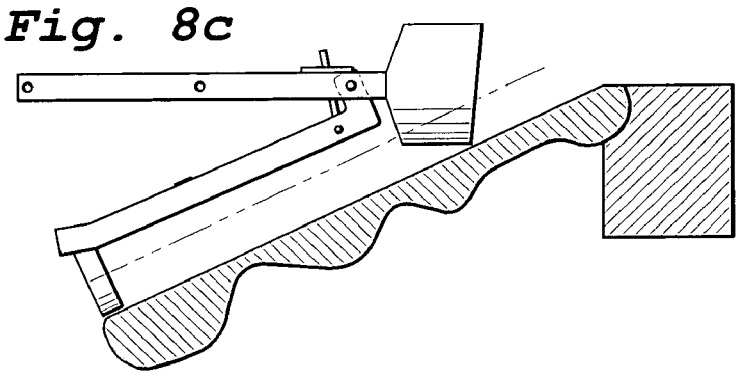

FIG. 8*c* shows, in a side view, a second operation position in cleaning by means of the tool according to FIG. 1.

DESCRIPTION OF EMBODIMENTS

From FIGS. 1-3 is evident how two parts of a cleaning tool according to the invention included in a cleaning device according to the invention appear and are assembled, viz, a front tool part 1*a-d*, 3, 6 and a rear tool part 2*a-d*. The front tool part 1*a-d*, 3, 6 comprises a first cleaning part 1*a*, a first holder part 1*b* with bracket 1*c* and a first strut 1*d*. The first holder part 1*b* and bracket 1*c* are provided by two elongated arms A1 and A2. The rear tool part 2 comprises a second cleaning part 2*a*, a second holder part 2*b* with bracket 2*c* and a second strut 2*d*. The second holder part 2*b* and bracket 2*c* are provided by two elongated arms A3 and A4. The front tool part 1*a-d*, 3, 6 and the rear tool part 2*a-d* are articulately interconnected with each other around the axle journals 3 that are fixedly connected to the first cleaning part 1*a* via the first holder part 1*b*. An adjustment device 4 enables adjustment of the desired angle between the first and second holder parts 1*b* and 2*b*. In the first holder part 1*b*, there are, in the bracket 1*c*, holes 5 for bolts or the like for mounting the first holder part 1*b* on a connecting rod or the like.

From FIG. 4 is evident that the first cleaning part 1*a* is in the form of a hollow cylinder open in the ends, which cylinder has an oval cross-section, the section being seen from the front. The shape of the cross-section is adapted to the shape of the outlet port 11 that is to be cleaned and the length of the cylinder is adapted to the depth of the same outlet port 11, i.e., usually the wall thickness of the boiler. Two reinforcements 6 are found on the inside of the cylinder, one on each side of a slot 7 in the otherwise continuous cross-section shape. Furthermore, from the figure the first strut 1*d*, the first holder part 1*b* and the axle journals 3 are evident, which all are included in the front tool part 1*a-d*, 3, 6.

From FIG. 5 is evident how the second cleaning part 2*a* appears in profile immediately behind a section that is seen from the front. By the presence of a slot 8, the second cleaning part 2*a* is divided into two flange-like downward-directed scraping devices 2*a*. The length of the second holder part 2*b* is adapted to the length of the outlet spout 12 that is to be cleaned.

In the cleaning device according to the invention, the first holder part 1*b* is, via the bracket 1*c* thereof, in any known way—for instance by screw joint, bolt joint, rivet joint, welding and/or brazing—mounted on a connecting rod 9. From FIGS. 6 and 7 is evident how the connecting rod 9 in turn is connected to a drive mechanism 10, which enables automatic operation of the cleaning device in a way decided beforehand. The drive mechanism 10 is of a previously known type.

Here, a suitable method of using the cleaning device according to the invention in cleaning an outlet port 11 with the appurtenant subjacent outlet spout 12 in connection with a soda recovery boiler 13 will now be accounted for more closely, and in connection with the FIGS. 8*a-c*.

First, the drive mechanism 10 is brought to direct the cleaning device against an outlet port 11 that is to be cleaned and in that connection locate the front end of the first cleaning part 1*a* right opposite said outlet port 11, see FIG. 8*a*, wherein it should be observed that in the respective FIGS. 8*a-c*, for the sake of clarity, only the front tool part 1*a-d*, 3, 6 and the rear tool part 2*a-d* of the cleaning device have been drawn-in, which parts together constitute said cleaning tool.

Then, the drive mechanism 10 is brought to insert the first cleaning part 1*a* in said outlet port 11 sufficiently far in order to entirely clean the port 11 from occurring solidified soda, cinder or the like, see FIG. 8*b*, which shows the introduction of the course of events. The cleaning takes place mechanically by the exterior shape of the first cleaning part 1*a* closely connecting to the interior shape of the outlet port 11, and accordingly occurring solidified soda, cinder or the like being "peeled" off from the interior walls of the outlet port 11. By the presence of the slot 7, the exterior shape of the first cleaning part 1*a* is somewhat flexible, i.e., the exterior wall in the cleaning part 1*a* may spring somewhat in the radial direction. In this way, the first cleaning part 1*a* may compensate for certain variations in the shape of the outlet port 11 and it is avoided that the first cleaning part 1*a* is caught in the outlet port 11 in the event that cinder and solidified soda have formed thicker layers than normally in the outlet port 11. The slot 7 also contributes to decreasing the risk of soda being caught on the first cleaning part 1*a* and comes with it back after accomplished cleaning of the outlet port 12.

Then, the drive mechanism 10 is brought to bring back said first cleaning part 1*a* entirely from said outlet port 11 and subsequently the drive mechanism 10 is brought to bring the cleaning device along the appurtenant outlet spout 12 that is to be cleaned and in such a way that the first cleaning part 1*a* and the second cleaning part 2*a* will run in the outlet spout 12 through the entire length thereof from above and down and hence clean the spout 12 from occurring solidified soda, cinder or the like, see FIG. 8*c*. This takes place in such a way that the first cleaning part 1*a* cleans an upper part of the spout 12 and the second cleaning part 2*a* simultaneously cleans a lower part of the spout 12, wherein an overlapping can take place so that an intermediate part of the spout 12 is cleaned by the first cleaning part 1*a* as well as the second cleaning part 2*a*. The second cleaning part 2*a* will also run past the lower end of the outlet spout 12 at the end of the spout, the second cleaning part 2*a* also cleaning around the lower end of the spout 12 and under the spout 12 in an area closest the lower end thereof, possible beard-like formations in the form of solidified soda, cinder or the like being removed also, there.

The drive mechanism 10 comprises a control system that may be manoeuvred automatically via a timer or manually from a manoeuvring room. The control system may comprise one or several computers.

Said front tool part 1*a-d*, 3, 6 and rear tool part 2*a-d* are manufactured from stainless acid-proof steel or another suitable material that resists corrosive environment and high temperature.

In the cleaning device according to the invention, the first holder part 1*b* does not need, via the bracket 1*c* thereof, to be fixedly mounted on the connecting rod 9 but may be movably, for instance articulatedly, mounted. In that connection, some kind of known locking device may be present in order to, for a shorter or longer time, fix the holder part 1*b* with the bracket 1*c* in a desired position in relation to the connecting rod 9. The first holder part 1*b* with the bracket 1*c* may alternatively be made integrally with the connecting rod 9.

Instead of being mounted on the front tool part 1*a-d*, 3, 6, the rear tool part 2*a-d* may be mounted directly on the connecting rod 9 and anywhere along the length thereof. The rear tool part 2*a-d* may alternatively be mounted on the front tool part 1*a-d*, 3, 6 as well as directly on the connecting rod 9. The rear tool part 2*a-d* may alternatively be made integrally with the front tool part 1*a-d*, 3, 6 and/or the connecting rod 9.

The cleaning device according to the invention may also be used by hand, i.e., without help from the drive mechanism 10, the connecting rod 9 having the front tool part 1*a-d*, 3, 6 and/or the rear tool part 2*a-d* hence being handled entirely manually and as an alternative to a simple manual lever.

The invention is not limited to the embodiments shown here but may be varied within the scope of the appended claims.

The invention claimed is:

1. A cleaning device for cleaning outlet ports and/or outlet spouts of soda recover boilers, the cleaning device comprising:

at least one connection rod, a front tool part mounted on said connecting rod, and at least one rear tool part articulately mounted on said front tool part, said front tool part comprising first and second elongated arms which mount at least one first cleaning part having a shape and size that closely conforms to a shape and size of an outlet port that is to be cleaned, so that said first cleaning part can be inserted into the outlet port to clean the same, and said rear tool part comprising at least one second cleaning part having a shape and size that closely conforms to a shape and size of an interior of an outlet spout that is to be cleaned, so that said second cleaning part can be inserted into the outlet spout to clean the same, wherein said first cleaning part is in the form of a hollow cylinder open at ends thereof and wherein an envelope surface of said cylinder includes a single slot that extends in a longitudinal direction of the cylinder from one end to the other of the cylinder and through the entire length thereof and thus enables said first cleaning part to be radially resilient.

2. The cleaning device according to claim 1, wherein said front tool part additionally comprises at least one first holder part with bracket.

3. The cleaning device according to claim 2, wherein said first holder part is connected to a front part of said connection rod.

4. The cleaning device according to claim 1, wherein said cylinder has an essentially circular or oval cross-section.

5. The cleaning device according to claim 1, wherein said rear tool part additionally comprises at least one second holder part with bracket.

6. The cleaning device according to claim 5, wherein said second cleaning part comprises at least one downwardly-depending scraping device for scraping the outlet spout.

7. The cleaning device according to claim 5, wherein said second holder part is articulately connected to said first holder part.

8. The cleaning device according to claim 1, wherein said connecting rod is connected to a drive mechanism, which enables automatic predetermined operation of the cleaning device.

9. The cleaning devise according to claim 1, wherein said rear tool part comprises third and fourth elongated arms which respectively mount a second cleaning part.

10. A cleaning tool comprising:

a front tool part for mounting on a connecting rod, and at least one rear tool part articulately mounted on said front tool part, said front tool part comprising first and second elongated arms which mount at least one first cleaning part having a shape and size that closely conforms to a shape and size of an outlet port that is to be cleaned, so that said first cleaning part can be inserted into the outlet port to clean the same, and said rear tool part comprising at least one second cleaning part having a shape and size that closely conforms to a shape and size of an interior of an outlet spout that is to be cleaned, so that said second cleaning part can be inserted into the outlet spout to clean the same, wherein said first cleaning part is in the form of a hollow cylinder open to ends thereof and wherein an envelope surface of said cylinder includes a single slot that extends in a longitudinal direction of the cylinder from one end to the other of the cylinder and through the entire length thereof and enables said first cleaning part to be radially resilient.

11. The cleaning tool according to claim 10, wherein said front tool part additionally comprises at least one first holder part with bracket.

12. The cleaning tool according to claim 10, wherein said rear tool part additionally comprises at least one second holder with bracket.

13. The cleaning tool according to claim 10, wherein said rear tool part comprises third and fourth elongated arms which respectively mount a second cleaning part.

* * * * *